US006398614B1

(12) United States Patent
Wu et al.

(10) Patent No.: US 6,398,614 B1
(45) Date of Patent: Jun. 4, 2002

(54) PINWHEEL ASSEMBLY

(76) Inventors: Pao-Chang Wu, 3F, 22, Lane 40, Second Pao An St., Su Lin Town, Taipei Shien (TW); Ping-Chao Lin, 9811 Talleyan Dr., Austin, TX (US) 78750

( * ) Notice: Subject to any disclaimer, the term of this patent is extended or adjusted under 35 U.S.C. 154(b) by 0 days.

(21) Appl. No.: 09/833,334

(22) Filed: Apr. 12, 2001

(51) Int. Cl.[7] ..... A63H 33/40

(52) U.S. Cl. ..... 446/217; 40/440; 446/218; 244/153 R

(58) Field of Search ..... 446/201, 217, 446/218; 40/440, 441, 439, 412; 244/153 R, 155 R

(56) References Cited

U.S. PATENT DOCUMENTS 5,183,244 A * 2/1993 Ortolano et al. ..... 269/43

6,206,747 B1 * 3/2001 Skwarek ..... 446/217

* cited by examiner

*Primary Examiner*—Jacob K. Ackun

(74) *Attorney, Agent, or Firm*—Alan Kamrath; Rider Bennett Egan & Arundel, LLP

(57) ABSTRACT

A pinwheel assembly has a polygonal main body, and a rotating device disposed in a center of the polygonal main body. The rotating device has a bearing and a hollow shaft. A plurality of support rods are connected to the bearing. The hollow shaft is inserted through the bearing. The polygonal main body has a plurality of diagonal lines. A plurality of through holes are formed on the diagonal lines of the polygonal main body. A plurality of triangular vanes are disposed on the polygonal main body. Each triangular vane has a triangular end bag. Each support rod is inserted in the corresponding triangular end bag and inserted through the corresponding through hole of the polygonal main body.

3 Claims, 4 Drawing Sheets

PINWHEEL ASSEMBLY

BACKGROUND OF THE INVENTION

The present invention relates to a pinwheel assembly. More particularly, the present invention relates to a pinwheel assembly which is used as a kite.

A conventional pinwheel device has a single decoration wheel. The decoration wheel has a plurality of paper vanes.

SUMMARY OF THE INVENTION

An object of the present invention is to provide a pinwheel assembly which can rotate freely under a wind.

Another object of the present invention is to provide a pinwheel assembly which can be used as a kite.

Accordingly, a pinwheel assembly comprises a polygonal main body, a rotating device disposed in a center of the polygonal main body, the rotating device having a bearing and a hollow shaft, a plurality of support rods connected to the bearing, the hollow shaft inserted through the bearing, the polygonal main body having a plurality of diagonal lines, a plurality of through holes formed on centers of the diagonal lines of the polygonal main body, a plurality of triangular vanes disposed on the polygonal main body along the diagonal lines, each of the triangular vanes having a triangular end bag, and each of the support rods inserted in the corresponding triangular end bag and inserted through the corresponding through hole of the polygonal main body.

DETAILED DESCRIPTION OF THE INVENTION

Figure 1:
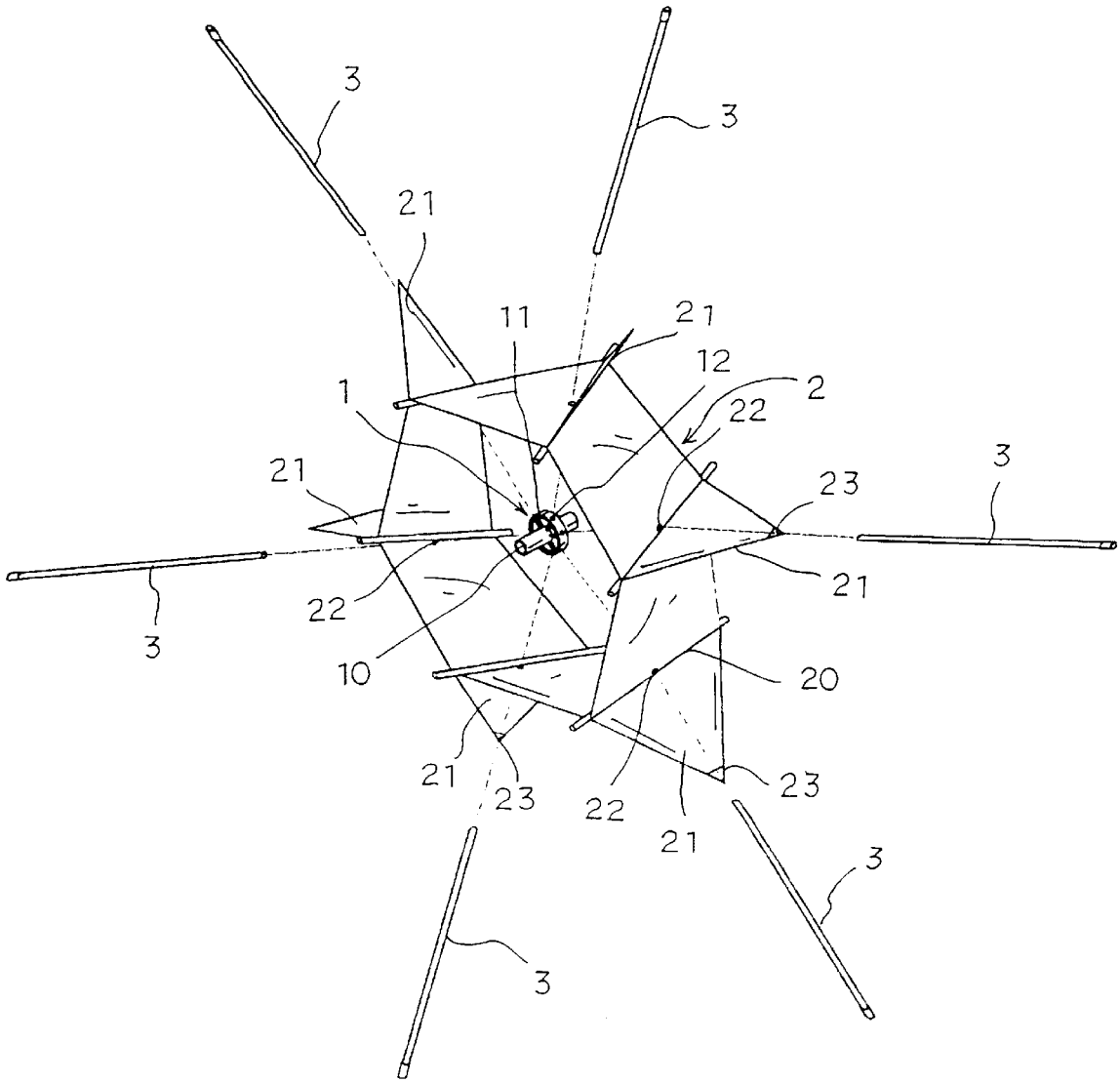
FIG. 1 is a perspective exploded view of a pinwheel assembly of a preferred embodiment in accordance with the present invention.
Figure 2:
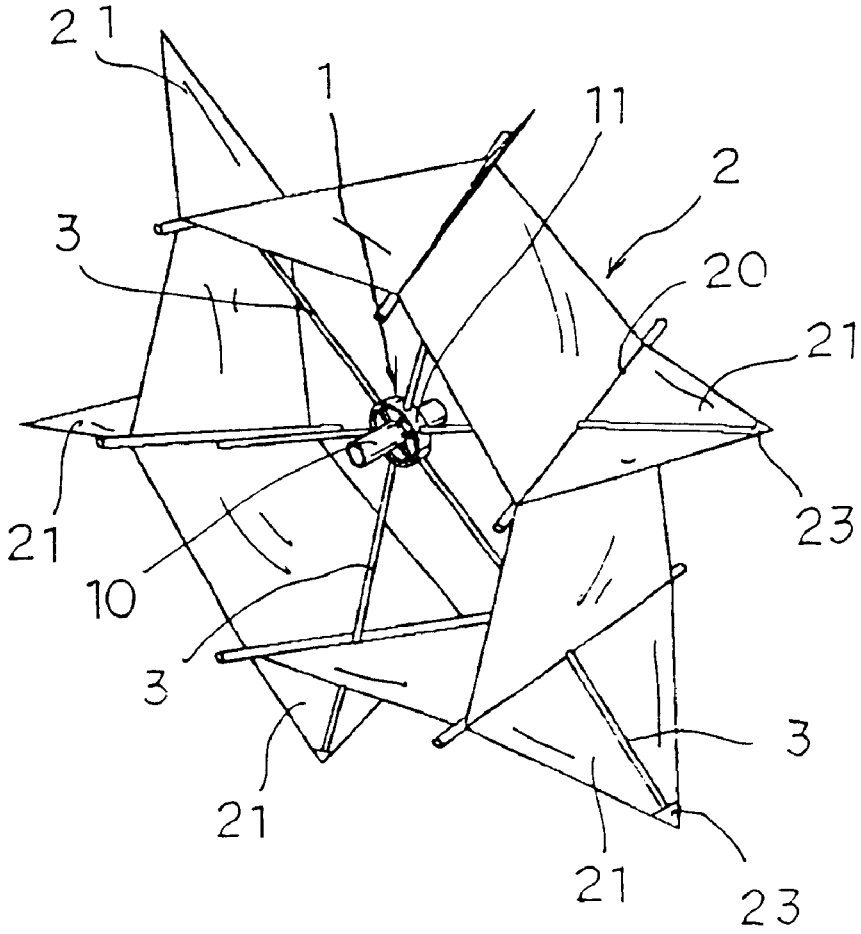
FIG. 2 is a perspective assembly view of a pinwheel assembly of a preferred embodiment in accordance with the present invention.

Referring to FIGS. 1 and 2, a pinwheel assembly comprises a polygonal main body 2, a rotating device 1 disposed in a center of the polygonal main body 2, the rotating device 1 having a bearing 11 and a hollow shaft 10, a plurality of support rods 3 connected to the bearing 11, and the hollow shaft 10 inserted through the bearing 1.

The polygonal main body 2 has a plurality of diagonal lines 20. A plurality of through holes 22 are formed on centers of the diagonal lines 20 of the polygonal main body 2.

A plurality of triangular vanes 21 are disposed on the polygonal main body 2 along the diagonal lines 20.

Each of the triangular vanes 21 has a triangular end bag 23.

Each of the support rods 3 is inserted in the corresponding triangular end bag 23 and inserted through the corresponding through hole 22 of the polygonal main body 2.

A plurality of apertures 12 are formed on the bearing 1 to receive the support rods 3.

The polygonal main body 2 is made of fabric.

Figure 3:
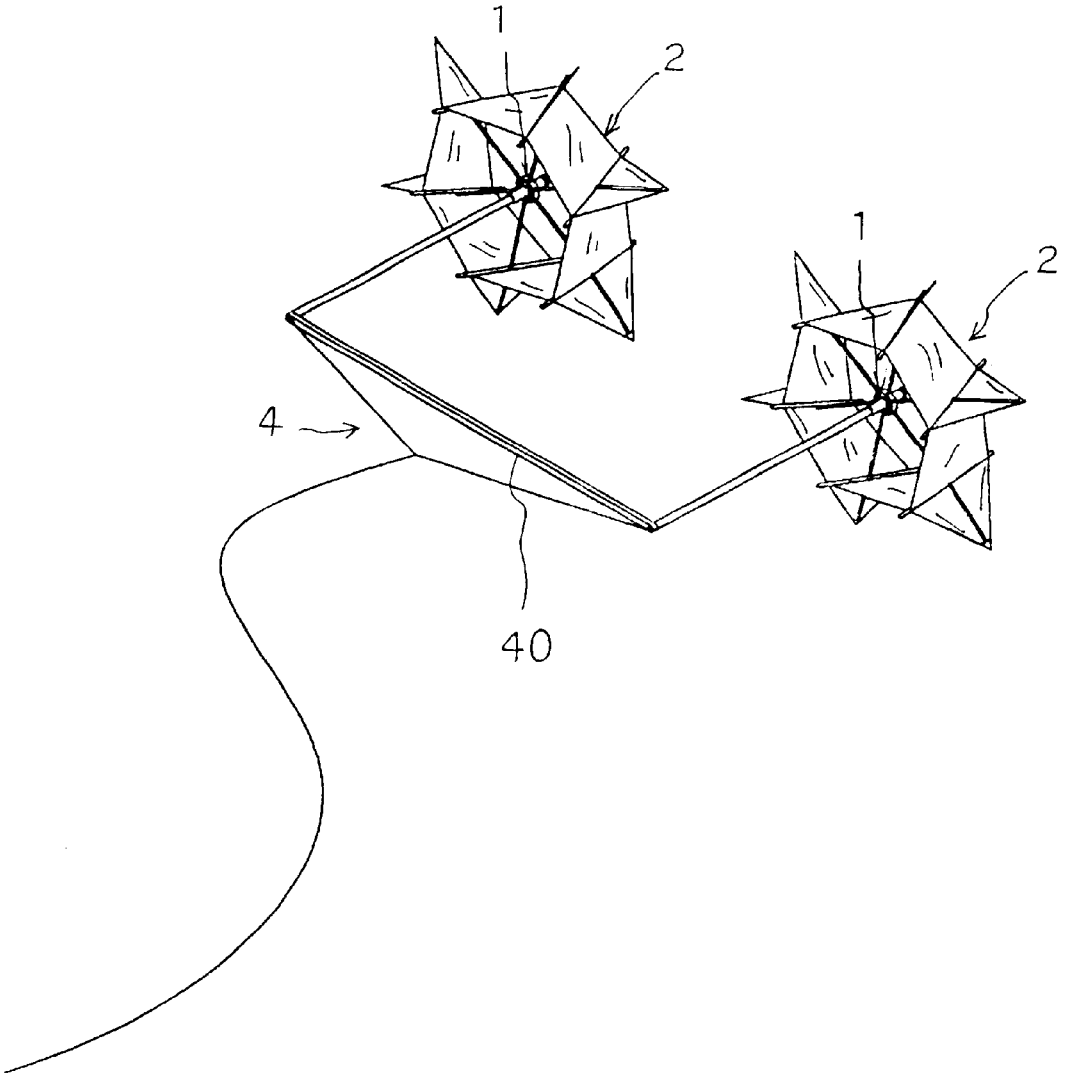
FIG. 3 is a schematic view illustrating a first application of a plurality of pinwheel assemblies as a kite.

Referring to FIG. 3, a kite 4 has a U-shaped rod 40 to receive two pinwheel assemblies.

Figure 4:
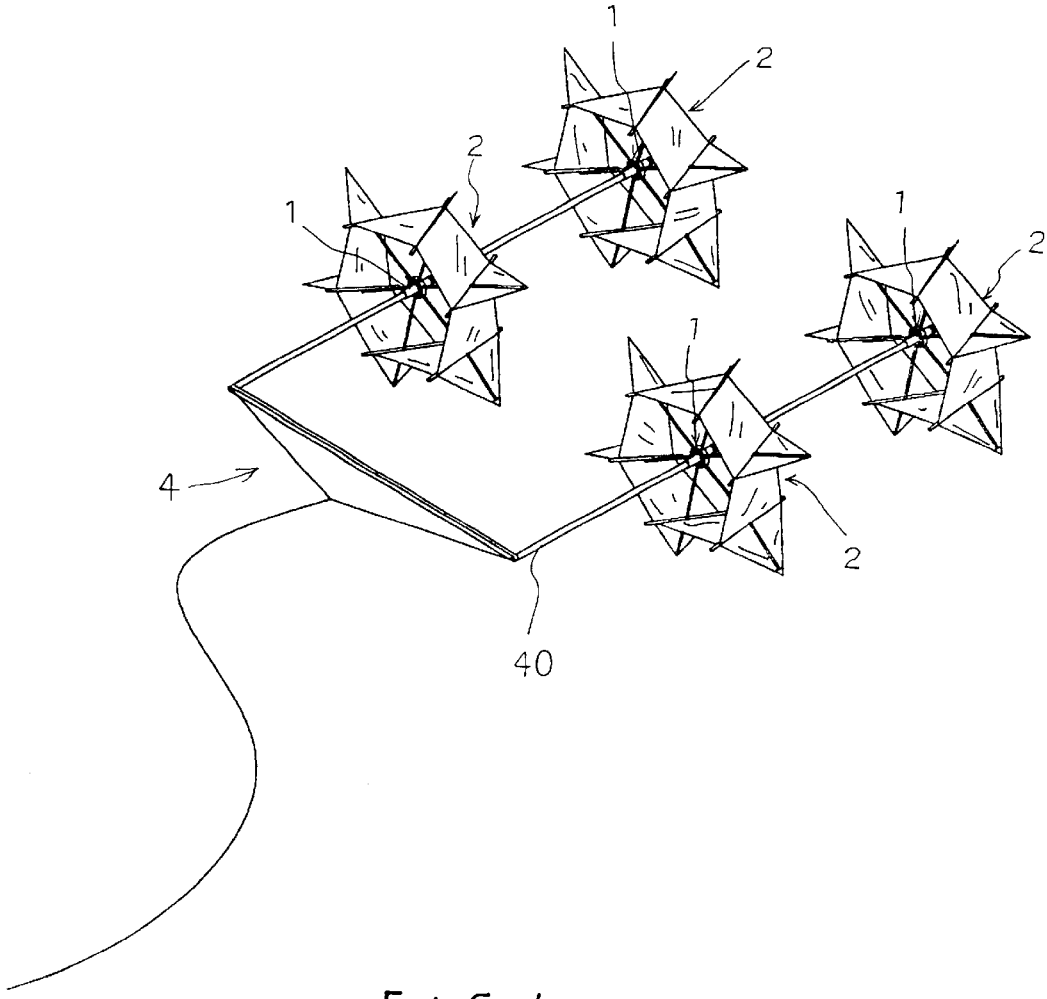
FIG. 4 is a schematic view illustrating a second application of a plurality of pinwheel assemblies as a kite.

Referring to FIG. 4, a kite 4 has a U-shaped rod 40 to receive two pairs of pinwheel assemblies.

The present invention is not limited to the above embodiments but various modification thereof may be made. Furthermore, various changes in form and detail may be made without departing from the scope of the present invention.

We claim:

1. A pinwheel assembly comprises a polygonal main body, a rotating device disposed in a center of the polygonal main body, the rotating device having a bearing and a hollow shaft, a plurality of support rods connected to the bearing, the hollow shaft inserted through the bearing, the polygonal main body having a plurality of diagonal lines, a plurality of through holes formed on centers of the diagonal lines of the polygonal main body, a plurality of triangular vanes disposed on the polygonal main body along the diagonal lines, each of the triangular vanes having a triangular end bag, and each of the support rods inserted in the corresponding triangular end bag and inserted through the corresponding through hole of the polygonal main body.

2. The pinwheel assembly as claimed in claim 1, wherein a plurality of apertures are formed on the bearing to receive the support rods.

3. The pinwheel assembly as claimed in claim 1, wherein the polygonal main body is made of fabric.

* * * * *